US007327827B2

(12) United States Patent
Sakamoto et al.

(10) Patent No.: US 7,327,827 B2
(45) Date of Patent: Feb. 5, 2008

(54) X-RAY HIGH VOLTAGE DEVICE

(75) Inventors: Kazuhiko Sakamoto, Kashiwa (JP); Hiroshi Takano, Moriya (JP)

(73) Assignee: Hitachi Medical Corporation, Tokyo (JP)

( * ) Notice: Subject to any disclaimer, the term of this patent is extended or adjusted under 35 U.S.C. 154(b) by 86 days.

(21) Appl. No.: 10/557,899

(22) PCT Filed: May 24, 2004

(86) PCT No.: PCT/JP2004/007081

§ 371 (c)(1),
(2), (4) Date: Nov. 22, 2005

(87) PCT Pub. No.: WO2004/105448

PCT Pub. Date: Feb. 12, 2004

(65) Prior Publication Data

US 2006/0274887 A1 Dec. 7, 2006

(30) Foreign Application Priority Data

May 23, 2003 (JP) ..... 2003-145975

(51) Int. Cl.
*H05G 1/10* (2006.01)

(52) U.S. Cl. ..... 378/103; 378/101; 378/104

(58) Field of Classification Search ..... 378/91, 378/101, 102, 103, 104, 105, 106, 107
See application file for complete search history.

(56) References Cited

U.S. PATENT DOCUMENTS 4,680,693 A * 7/1987 Carron ..... 363/98
4,737,974 A * 4/1988 Hino et al. ..... 378/105
4,741,010 A * 4/1988 Hino et al. ..... 378/105
4,761,804 A * 8/1988 Yahata ..... 378/109
4,783,795 A * 11/1988 Yahata ..... 378/105
4,794,505 A * 12/1988 Hino et al. ..... 363/17
4,794,506 A * 12/1988 Hino et al. ..... 363/25
5,329,568 A * 7/1994 Buehler et al. ..... 378/110
5,731,968 A * 3/1998 Van Der Broeck et al. ... 363/71
5,923,549 A * 7/1999 Kobayashi et al. ..... 363/65
6,072,856 A * 6/2000 Van Der Broeck et al. . 378/101

(Continued)

FOREIGN PATENT DOCUMENTS

JP 8-212948 8/1996

(Continued)

*Primary Examiner*—Allen C. Ho
(74) *Attorney, Agent, or Firm*—Antonelli, Terry, Stout & Kraus, LLP.

(57) ABSTRACT

A semiconductor switch 12 connected in series with a smoothing capacitor 12 is constituted by connecting in parallel a diode 13D which permits to flow current regenerated from energy of electric charges stored in a high voltage capacitor 17 to a primary side of a high voltage transformer 15 for the smoothing capacitor 12 and switching means 13S which interrupts an output from the smoothing capacitor 12, and after turning off the switching means 13S, through alternative on and off control of switching means 161S~164S the energy of electric charges stored in the high voltage capacitor 17 is regenerated to the smoothing capacitor 12 by making use of parasitic leakage inductance 15L. As a result, an X-ray high voltage device is provided which permits to drop a wave tail of a tube voltage in a high speed without complexing the structure of the high voltage part thereof.

18 Claims, 7 Drawing Sheets

U.S. PATENT DOCUMENTS 6,184,662 B1 * 2/2001 Yabuuchi et al. ..... 323/222
6,683,800 B2 * 1/2004 Loef et al. ..... 363/49
6,917,531 B2 * 7/2005 Scheel et al. ..... 363/97

FOREIGN PATENT DOCUMENTS

JP 11-74096 3/1999
JP 11-76096 3/1999
JP 11-266582 9/1999
JP 2001-284097 10/2001

* cited by examiner

X-RAY HIGH VOLTAGE DEVICE

FIELD OF THE INVENTION

The present invention relates to a medical or industrial use X-ray high voltage device which applies a high voltage to an X-ray tube therein.

CONVENTIONAL ART

An X-ray high voltage device is generally constituted in such a manner that after rectifying an AC voltage with a rectifier circuit, the rectified voltage is smoothed by a smoothing capacitor and then inverted into a high frequency AC voltage with a low voltage side inverter, the high frequency AC voltage is boosted up with a high voltage transformer of which primary winding is connected to the low voltage side inverter, the boosted up AC high voltage is rectified and inverted into a DC high voltage with a high voltage rectifier to which a secondary winding of the high voltage transformer is connected, the inverted DC high voltage is smoothed by such as a capacitor added to the high voltage side and a high voltage capacitor constituted by a stray capacitance included in high voltage cables and the smoothed DC high voltage is supplied to an X-ray tube. In the X-ray high voltage device thus constituted, since the high voltage rectifier is provided at the input side of the high voltage capacitor, electric charges stored in the high voltage capacitor are discharged only via the X-ray tube, for this reason, although a voltage between an anode and a cathode of the X-ray tube (herein below will be called as tube voltage) can be built up in high speed, it was difficult to drop the tube voltage in high speed. Therefore, in an X-ray high voltage device which is required to generate a high speed pulse shaped tube voltage so as to perform cinematic photography which photographs bloodstream in blood vessel on cinematic films as an animating picture and a pulsating fluoroscopy which is for obtaining high quality and real time images of a region of interest when manipulating a catheter in a blood vessel such as for a medical use X-ray device, a waveform of the tube voltage when dropping (herein below will be called as wave tail) causes a problem. Namely, such wave tail shows almost no effect on X-ray images formed on X-ray films and X-ray TV, moreover, the wave tail causes the X-ray tube to irradiate many amount of low energy X-ray which likely causes a harmful exposure to a subject. Such ineffective exposure caused by the wave tail can in particular impede medical treatment under high quality fluoroscopy represented by interventional radiology.

Now a trial calculation is performed in the followings with regard to the degree of time required for discharging the electric charges stored in the high voltage capacitor as well as degree of power loss (in a form of heat generation) caused thereby with respect to the pulse shaped high voltage output required inherently. For example, when assuming that the load resistance of an X-ray tube is RL and the static capacitance of a high voltage capacitor is Cf, the discharge time constant of the high voltage capacitor is expressed as RL×Cf. At the time of pulsating fluoroscopy, for example, when assuming that the tube voltage is 100 kV, the tube current is 10 mA and the static capacitance Cf is 5000 pF, the wave tail time constant of the tube voltage is expressed by the following mathematical formula (1);

$$\text{Wave tail time constant}=(100\ \text{kV}/10\ \text{mA})\times 5000\ \text{pF}=50\ \text{ms} \quad (1)$$

Normally, a pulse rate in pulsating fluoroscopy is 15~60 pulse/s as shown in FIG. 7, the cycle thereof is about 66.7 ms~16.7 ms and the pulse width of the tube voltage is about 3~a few ms. Accordingly, in the case when the wave tail time constant is 50 ms, the tube voltage does not drop to zero and there exists a wave tail which amounts to a few times of the pulse width actually required between t2 and t3. FIG. 7 shows a conventional tube voltage waveform under these conditions, as seen from the drawing, it will be understood that since the subsequent pulse shaped tube voltage begins to rise at time t2 before the wave tail reaches to zero, a significant amount of X-ray due to low tube voltage is emitted as well as a tube voltage is always and continuously applied to the X-ray tube to generate heat therefrom. Further, during the wave tail period of the tube voltage, since the power stored in the high voltage capacitor is consumed by the X-ray tube, the internal temperature of the X-ray tube is increased accordingly, thereby, the life time of the X-ray is shortened as well as limitations such as lowering permissible X-ray conditions after pulse shape X-ray outputting are possibly caused.

In order to resolve these problems, for example, JP-A-8-212948 discloses an X-ray high voltage device in which a series circuit of a current limiting impedance and a high speed switch is provided between the anode and cathode of an X-ray tube and electric charges stored in a capacitor at the high voltage side are discharged in high speed, further, for example, JP-A-11-266582 discloses an X-ray high voltage device in which through an addition of a power regeneration use second high voltage transformer electric charges stored in a capacitor at the high voltage side are regenerated at the low voltage side.

However, in the case of the X-ray high voltage device as disclosed in JP-A-11-266582 in which the power regeneration use second high voltage transformer is added, the structure of the high voltage part complexes. Further, in the case of JP-A-8-212948 in which the electric charge energy stored in the high voltage capacitor is consumed in the current limiting use impedance, the power consumed in this instance is expressed by the following mathematical formula (2), wherein the pulse rate is assumed as 60 pulse/s and the power is converted from the electric charge energy stored in the high voltage capacitor. Namely, during performing the pulse fluoroscopy, electric power to the extent of 1.5 kW is always lost in the current limiting impedance to generate heat. For this reason the current limiting impedance has to be cooled, which necessitates a separate cooling device and also complexes the structure of the high voltage part.

$$\text{Power consumed}=\tfrac{1}{2}\times CfeT^2\times\text{pulse rate}=\tfrac{1}{2}\times 5000\ \text{pF}\times 100\ \text{kV}^2\times 60\ \text{pulse/s}=1500\ \text{W} \quad (2)$$

Patent document 1:JP-A-8-212948 bulletin

Patent document 2:JP-A-11-266582 bulletin

An object of the present invention is to provide an X-ray high voltage device which permits to drop the wave tail of a tube voltage in high speed without complexing the structure of the high voltage portion of the device.

SUMMARY OF THE INVENTION

In order to achieve the above object, an X-ray high voltage device according to the present invention is constituted by a low voltage DC source, a low voltage side inverter of which input side is connected to the low voltage DC source and inverts the low voltage DC from the low voltage DC source into high frequency AC voltage and outputs the same, a high voltage transformer of which primary winding is connected to the output side of the low voltage side inverter and boosts up the high frequency AC voltage from the low voltage inverter, a high voltage side rectifier unit of which input side is connected to the secondary winding of the high voltage transformer and rectifies the AC voltage boosted up by the high voltage transformer, a high voltage side smoothing capacitor including stray capacitance of a high voltage cable connected to the output side of the high voltage side rectifier unit and an X-ray tube connected between terminals of the high voltage smoothing capacitor and is characterized in that the X-ray high voltage device is further provided with a regeneration circuit which regenerates energy of electric charges stored in the high voltage side capacitor by making use of the high voltage transformer after applying a tube voltage of a predetermined level to the X-ray tube for a predetermined period through a predetermined switching operation of the low voltage side inverter.

Further, an X-ray high voltage device according to the present invention is provided with a rectifier circuit which rectifies an AC voltage, a smoothing capacitor which smoothes the output of the rectifier circuit, a low voltage side inverter which inverts the output of the smoothing capacitor into a high frequency AC voltage, a high voltage transformer of which primary winding is connected to the low voltage side inverter and which boosts up the AC voltage, a high voltage side inverter which is connected to the secondary winding of the high voltage transformer and inverts the boosted up AC voltage into a DC high voltage, a high voltage capacitor which is connected to the high voltage side inverter and smoothes the DC high voltage and an X-ray tube connected to the high voltage capacitor and is characterized in that the high voltage side inverter is provided with a switching means which provides energy of electric charges stored in the high voltage capacitor alternatively and in a predetermined frequency to the high voltage transformer, a regeneration circuit for the high voltage capacitor is formed at the primary side representing the low voltage side of the high voltage transformer and the regeneration circuit is provided with a switching means which interrupts the output of the smoothing capacitor and a diode which permits to flow a regeneration current from the high voltage capacitor to the low voltage side.

Since the X-ray high voltage device according to the present invention regenerates the energy of electric charges stored in the high voltage capacitor to the DC voltage source such as the smoothing capacitor, such as the current limiting use impedance and the regeneration use high voltage transformer which were required in conventional art are unnecessitated, the structure of the high voltage side is simplified and the size thereof is reduced and further, since the wave tail of the tube voltage can be dropped rapidly, the ineffective exposure can be reduced. Moreover, the energy regenerated into the smoothing capacitor can be effectively utilized for generation of the subsequent tube voltage pulse.

Further, the low voltage side inverter is constituted so as to perform a switching control in which shorting and opening of the primary side of the high voltage transformer is repeated periodically for regenerating the energy of the electric charges stored in the high voltage capacitor. Thereby, the low voltage side inverter is operated as a chopper circuit which at least turns on a switch in the low voltage side inverter and turns off the same in earlier timing than the frequency of the AC voltage and thereby chops the current flowing through the parasitic leakage inductance. Thereby, the current flowing through the parasitic leakage inductance is rapidly sent out to the smoothing capacitor 12 and charges the same. Namely, by making use of the parasitic leakage inductance of the primary winding of the high voltage transformer, the energy of the electric charges stored in the high voltage capacitor can be regenerated to the primary side of the high voltage transformer.

Still further, a high voltage device according to the present invention comprises a low voltage DC source, a low voltage side inverter of which input side is connected to the low voltage DC source and inverts the current from the low voltage DC source into high frequency AC voltage and outputs the same, a high voltage transformer of which primary winding is connected to the output side of the low voltage side inverter and boosts up the high frequency AC voltage from the low voltage inverter, a high voltage rectifier of which input side is connected to the secondary winding of the high voltage transformer and which rectifies the AC voltage boosted up by the high voltage transformer, a high voltage side capacitor connected to the output side of the high voltage rectifier and a X-ray generation device connected between terminals of the high voltage side capacitor and is characterized in that electric charge energy stored in the high voltage side capacitor is regenerated from the output side to the input side via the high voltage transformer.

Further, the high voltage device according to the present invention is characterized in that being further provided with a regenerating means which performs regeneration of the electric charge energy.

Further, the high voltage device according to the present invention is characterized in that the regenerating means causes to reduce the voltage at the input side lower than the voltage at the output side.

Further, the high voltage device according to the present invention is characterized in that the regenerating means is provided between the output side of the low voltage DC source and the input side of the high voltage side capacitor.

Further, the high voltage device according to the present invention is characterized in that the regenerating means is at least a current control means provided between the low voltage DC source and the high voltage transformer.

Further, the high voltage device according to the present invention is characterized in that the regenerating means is at least provided in the high voltage rectifier.

Further, the high voltage device according to the present invention is characterized in that the regenerating means is the low voltage side inverter.

Further, the high voltage device according to the present invention is characterized in that the regenerating means is an element which only allows current conduction from the output side to the input side during the regeneration and allows bi-directional current conduction other than the regeneration period.

Further, the high voltage device according to the present invention is characterized in that the element is a parallel connection of a diode and a switch.

Further, the high voltage device according to the present invention is characterized in that the high voltage rectifier is further provided with a switching element which receives the electric charges in the high voltage side capacitor, inverts the same into an AC and returns the same to the input side.

Further, the high voltage device according to the present invention is characterized in that the high voltage rectifier is constituted by a diode bridge and switching elements each of which is connected in parallel with respective diodes constituting the diode bridge.

Further, the high voltage device according to the present invention is characterized in that being further provided with regeneration control means which controls the operation of the regenerating means.

Further, the high voltage device according to the present invention is characterized in that the regeneration control means turns off the switch in the current control means provided between the low voltage DC source and the high voltage transformer at the start of the regeneration.

Further, the high voltage device according to the present invention is characterized in that the regeneration control means causes to reduce the voltage of the input side lower than the voltage of the output side by witching the low voltage side inverter.

Further, the high voltage device according to the present invention is characterized in that the regeneration control means inverts the switching element in the high voltage rectifier into AC during the regeneration and returns the energy to the input side.

Further, the high voltage device according to the present invention is characterized in that the switching frequency of the low voltage side inverter is higher than the AC frequency of the switching element in the high voltage rectifier.

Further, the high voltage device according to the present invention is characterized in that the X-ray generation device is an X-ray tube.

Further, the high voltage device according to the present invention is characterized in that the X-ray tube is a neutral point grounded type X-ray tube and the high voltage rectifier is provided at least in two sets.

Further, the high voltage device according to the present invention is characterized in that the low voltage DC source includes at least one of a capacitor and a battery.

Further, an X-ray high voltage device according to the present invention comprises a DC power supply means with a low voltage electric charge storing means, a DC/AC inverting means which inverts the output of the DC power supply means into a high frequency AC voltage and outputs the same, a high voltage transforming means which boosts up the high frequency AC voltage from the DC/AC inverting means, a rectifying means which rectifies the boosted up high frequency AC voltage and generates a DC high voltage, a high voltage electric charge storing means including stray capacitance of cables connected to the output side of the rectifying means and an X-ray generating means which is connected between the terminals of the high voltage electric charge storing means and receives DC high voltage from the high voltage electric charge storing means, when an X-ray irradiation command is turned on, and generates X-ray, the X-ray high voltage device is characterized in that, the rectifying means is provided with a first regenerating means which causes electric charges to flow in reverse direction from the secondary side to the primary side of the high voltage transforming means and a second regenerating means which causes to regenerate electric charges remained in the high voltage electric charge storing means to the low voltage side DC power supply means via the high voltage transforming means, when the X-ray irradiation command is turned off.

Further, the X-ray high voltage device according to the present invention is characterized in that the first regenerating means is a DC/AC inverting means which is incorporated in the rectifying means and the second regenerating means includes a semiconductor element which is connected between the DC power supply means and the DC/AC inverter and allows current conduction only in a direction from the DC/AC inverting means to the DC power supply means, when the X-ray irradiation command is turned off.

BEST MODES FOR CARRYING OUT THE INVENTION

Figure 1:
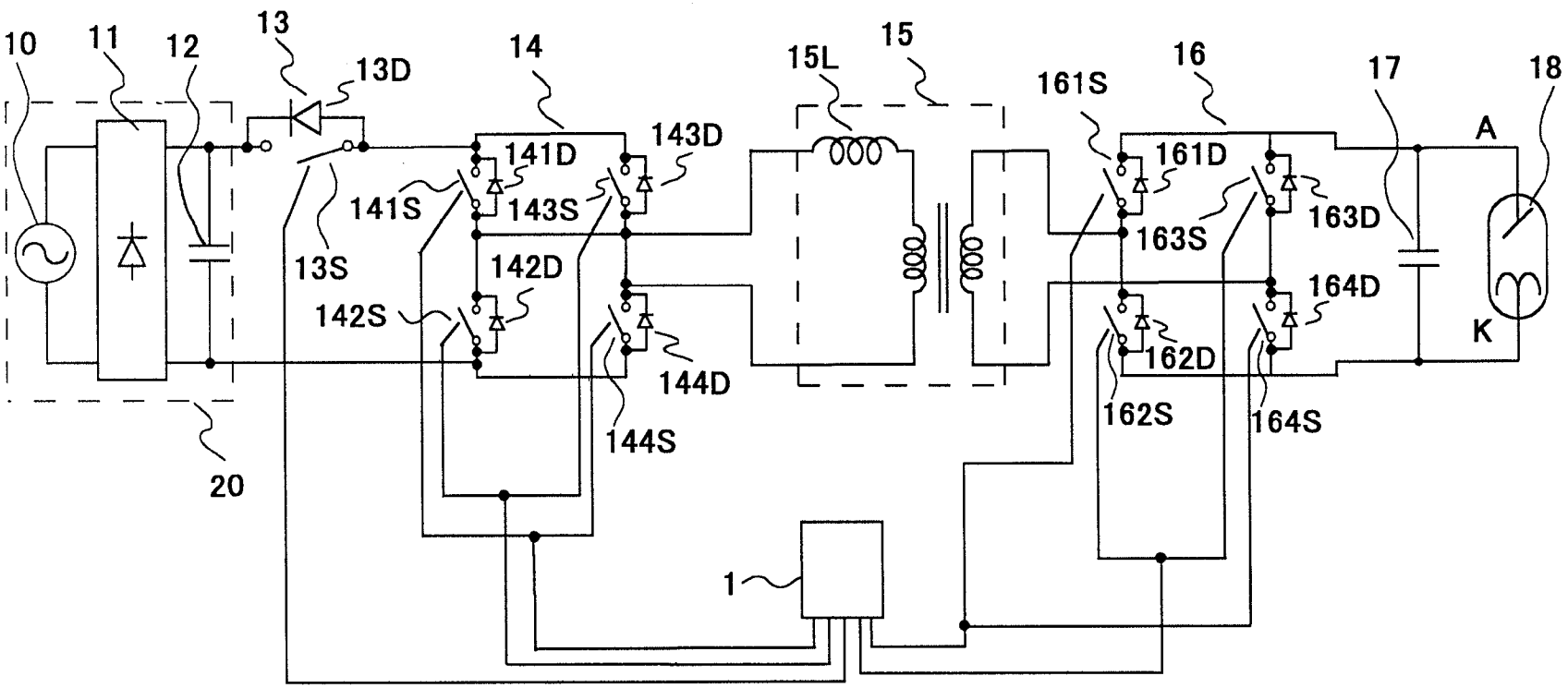
FIG. 1 is a circuit diagram of an X-ray high voltage device according to embodiment 1 of the present invention.

FIG. 1 is a circuit diagram of an X-ray high voltage device according to embodiment 1 of the present invention.

A rectifier 11 connected to an AC source 10 converts an AC voltage of the AC source into a DC and the DC voltage is smoothed by a smoothing capacitor 12. The AC source 10, the rectifier 11 and the smoothing capacitor 12 constitute a low voltage DC source 20 in the X-ray high voltage device. To the smoothing capacitor 12 a semiconductor switch 13 is connected in series, and the semiconductor switch 13 is constituted by connecting in parallel a diode 13D which flows a regenerated current to the smoothing capacitor 12 and a switching means 13S which interrupts an output from the smoothing capacitor 12. A low voltage side inverter 14, which inverts a DC voltage supplied from the semiconductor switch 13 into a high frequency AC voltage, is connected to a primary winding of a high voltage transformer 15. The low voltage side inverter 14 is constituted by diodes 141D~144D connected in a bridge form and switching means 141D~144S connected in parallel with the respective diodes 141D~144D. Further, the bridge connection of the diodes can be either a full bridge or a half bridge.

At the secondary side of the high voltage transformer 15, a high voltage side rectifier/inverter 16, hereinafter referred to as high voltage side inverter 16, which rectifies the boosted up AC voltage is provided, and the high voltage side inverter 16 is constituted by diodes 161D~164D connected in a bridge form and in particular switching means 161S~164S connected in parallel with the respective diodes 161D~164D. To the high voltage inverter 16 a high voltage capacitor 17 is connected which smoothes the output voltage. The high voltage capacitor 17 is constituted such as by a stray capacitance of cables connecting the high voltage side inverter 16 and an X-ray tube 18 and depending on necessity by an additional smoothing use high voltage capacitor.

The semiconductor switch 13S is, for example, a voltage drive type semiconductor switch and is selected from one having a withstanding voltage of about 1200V and a current rating of about 400 A. As the high voltage switching means 161S~164S in the high voltage side inverter 16, cascade connected MOSFETs are used as disclosed, for example, in JP-A-2001-284097 and JP-A-8-212948. A regeneration control means 1 is a control means which regenerates an electric power, for example, by controlling the switching means 141S~144S, the semiconductor switch and the switching means 161S~164S. Further, a turn ratio of the high voltage transformer 15 is about 1:400~900 in order to obtain a tube voltage up to about 150 kV which is necessary for a medical use from a commercial AC power source 10.

Figure 2:
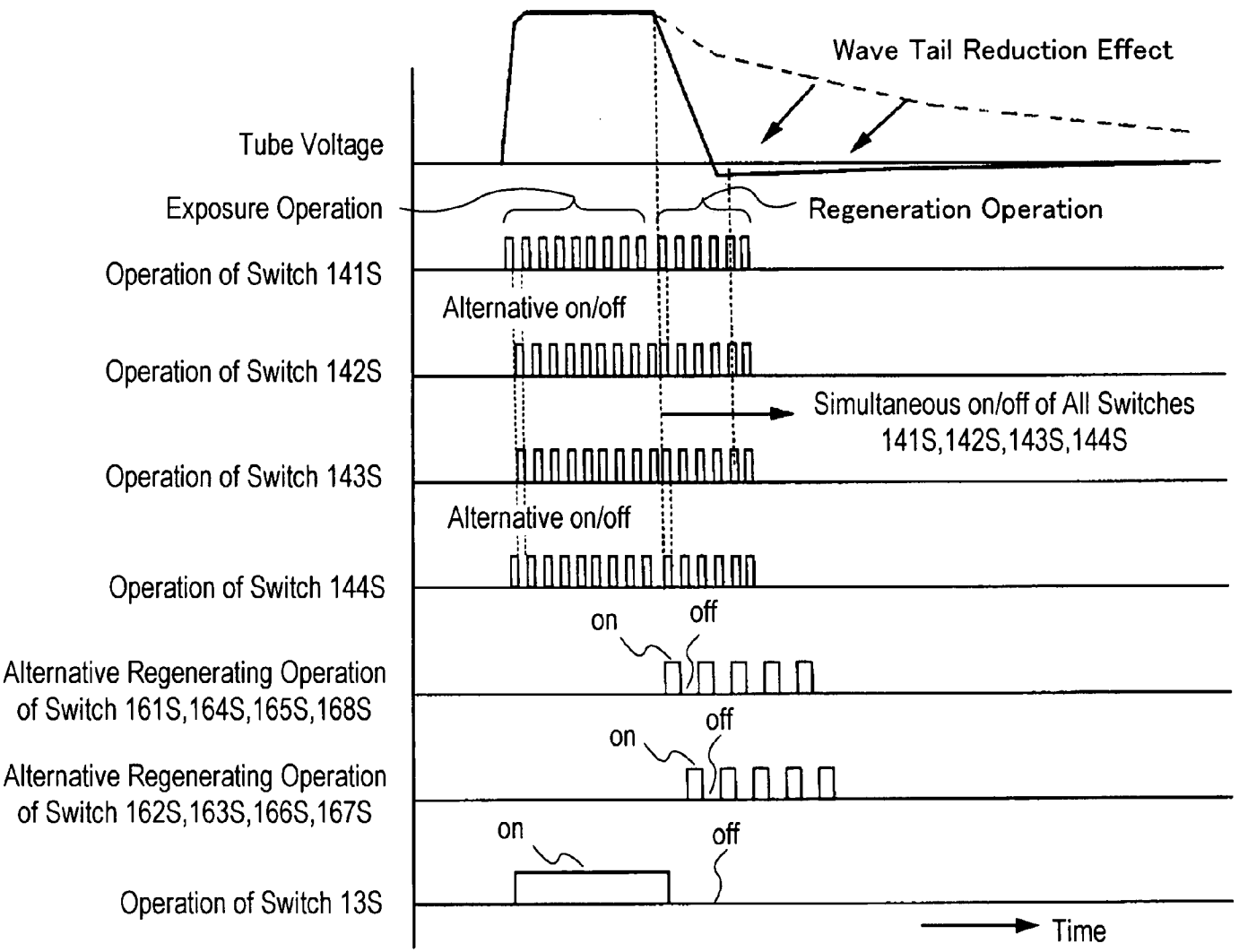
FIG. 2 is an operation waveform diagram of the X-ray high voltage device as shown in FIG. 1.

Now, an operation of the above explained X-ray high voltage device will be explained with reference to the operation waveform diagram as shown in FIG. 2.

By turning on the switching means 13S in the semiconductor switch 13 and rendering the low voltage side inverter 14 operative, a high frequency AC is supplied to the high voltage transformer 15. After rectifying the output voltage with the high voltage inverter 6 and further smoothing the same with the high voltage capacitor 17, a fast building up tube voltage (for example, about 1 ms) as shown in the drawing is applied to the X-ray tube 18.

Figure 7:
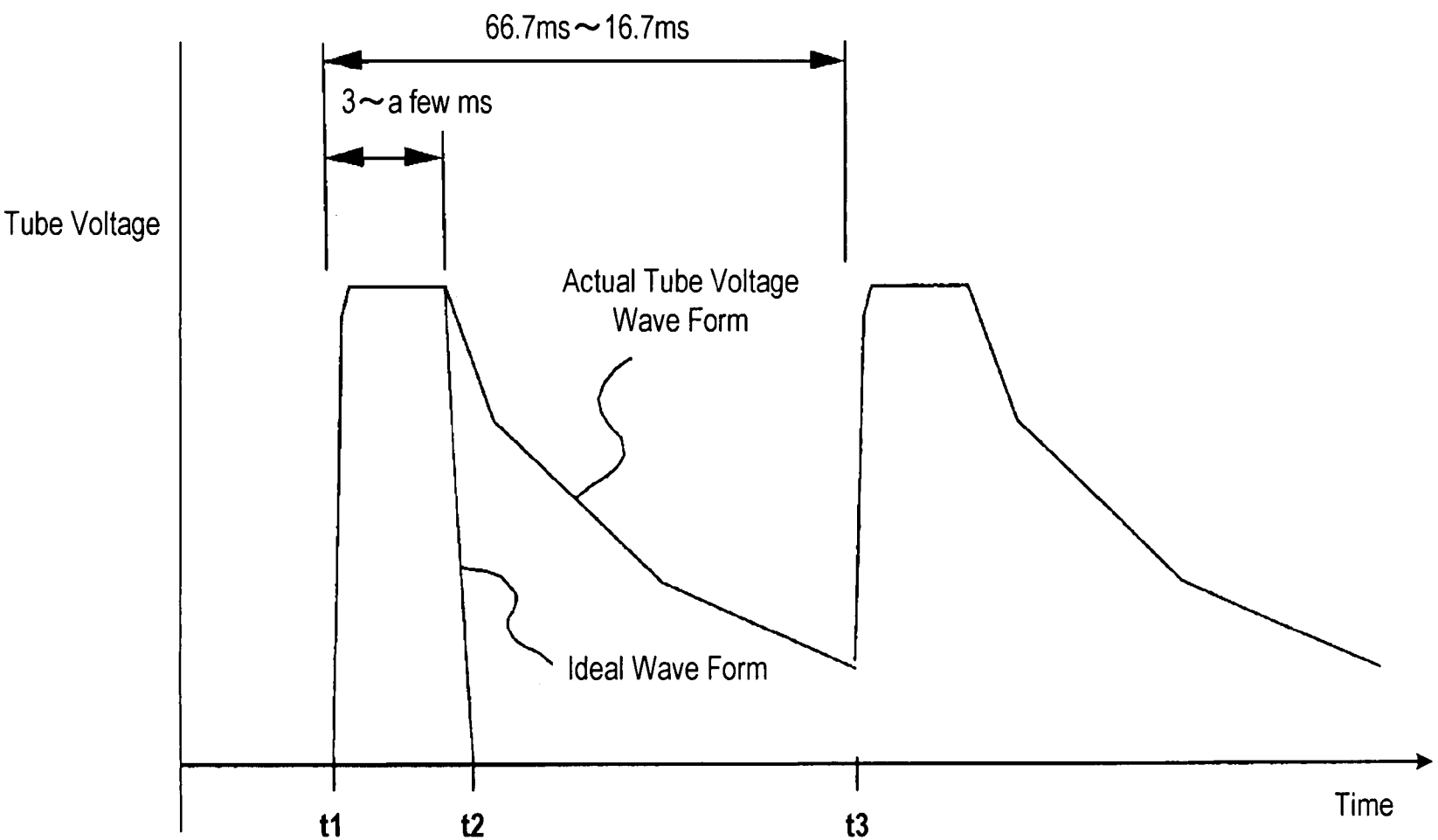
FIG. 7 is a tube voltage waveform diagram of an X-ray high voltage device.

In order to drop the tube voltage, the output from the smoothing capacitor 12 is interrupted immediately after t2 as shown in FIG. 7 by turning off the switching means 13S in the semiconductor switch 13. In this moment, all of the switching means 141S~144S in the low voltage inverter 14 are turned on and off at the same time. Further, when the switching means 161S and 164S and switching means 162S and 163S in the high voltage inverter 16 are alternatively on and off controlled, electric charges stored in the high voltage capacitor 17 supply an AC high voltage to the secondary side of the high voltage transformer 15. The frequency of the alternative on and off control is about 30~50 Hz for the reason of high voltage.

At the time when all of the switching means 141S~144S in the low voltage inverter 14 are simultaneously turned on, since the voltage of the primary side of the high voltage transformer 15 is zero, an electric power is supplied from the secondary side. In this instance, the current flowing to the primary side of the high voltage transformer 15 keeps flowing while being restricted by the parasitic leakage inductance 15L of the high voltage transformer 15. Subsequently, when the switching means 141S~144S in the low voltage side inverter 14 are at the same time turned off, the diodes 141D~144D and the diode 13D are rendered conductive and the current induced in the parasitic leakage inductance 15L charges the smoothing capacitor 12 and are regenerated. Alternatively, the low voltage side inverter 14 is operated as a chopper circuit in which by turning on at least the switch 142S or 144S in the low voltage inverter 14 and turning off the same in a faster timing than the frequency of the AC current, the current flowing through the parasitic leakage inductance 15L is chopped. Thereby, the current flowing through the parasitic leakage inductance 15L is rapidly sent out to the smoothing capacitor 12 and charges the same.

According to the X-ray high voltage device of the present invention as has been explained above, the tube voltage is suddenly dropped and the wave tail thereof can be greatly reduced as shown in FIG. 2 without complexing the structure of the high voltage side as well as without being troubled by counter measuring the heating of the current limiting use impedance.

However, the present invention does not prevent adding another inductance to the parasitic leakage inductance if required. Further, in the present invention, since the parallel connected switching means 13S and diode 13D is provided between the smoothing capacitor 12 and the low voltage side inverter 14, the energy of electric charges stored in the high voltage capacitor 17 is regenerated in the smoothing capacitor 12 and can be utilized.

Further, in particular, in a system in which a DC is directly applied to both terminals of the smoothing capacitor 12 without using the AC source 10, since the energy of electric charges stored in the high voltage capacitor 17 is designed to regenerate to the smoothing capacitor 12, the energy is effectively used to generate a subsequent tube voltage pulse from the smoothing capacitor 12 as well as when an X-ray device including an X-ray CT device using such X-ray high voltage device is used, exposure due to low energy X-ray which is harmful to a subject can be reduced.

Embodiment 2

Figure 3:
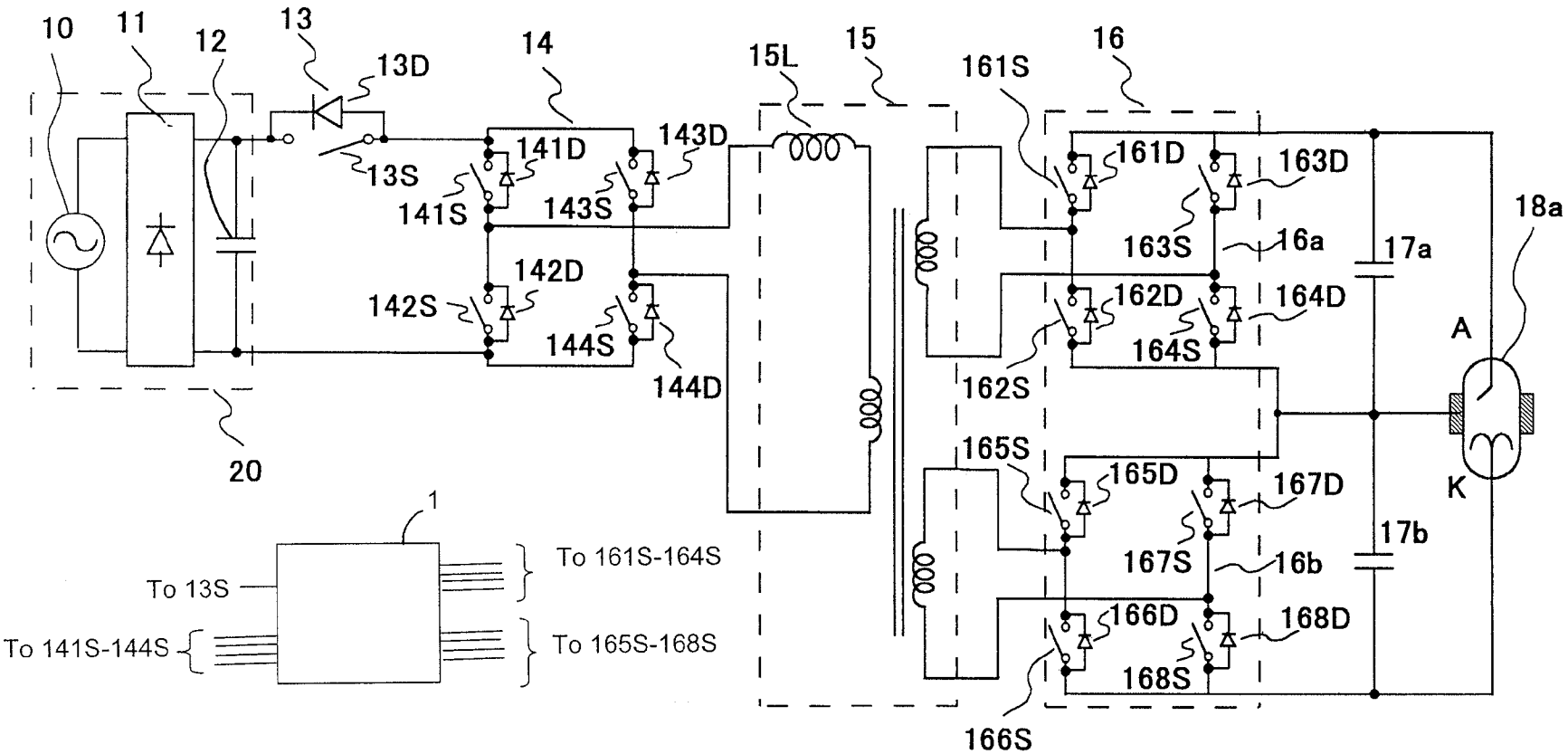
FIG. 3 is a circuit diagram of an X-ray high voltage device according to embodiment 2 of the present invention.

FIG. 3 is a circuit diagram showing an X-ray high voltage device according to another embodiment of the present invention.

The X-ray high voltage device according to the present embodiment uses a neutral point grounded type X-ray tube 18*a*, thereby, the withstanding voltage of the high voltage cables is halved to 75 kV, the secondary winding of a high voltage transformer 15 is divided into two parts one for the anode side of the X-ray tube 18*a* and the other is for the cathode side thereof and a high voltage inverter 16 is constituted by an anode side high voltage inverter 16*a* including switching means 161S~164S connected to the secondary winding of the anode side and diodes 161D~164D and a cathode side high voltage inverter 16*b* including switching means 165S~168S connected to the secondary winding of the cathode side and diodes 165D~168D.

In this type of the X-ray high voltage device, like the embodiment 1 as has been explained above, with respect to a smoothing capacitor 12 a semiconductor switch 13 is connected in series and the semiconductor switch 13 is constituted by connecting in parallel a diode 13D which flows regenerated current to the smoothing capacitor 12 and a switching means 13S which interrupts an output from the smoothing capacitor 12. A low voltage side inverter 14 connected to the primary side of the high voltage transformer 15 is constituted by diodes 141D~144D connected in a bridge form and switching means 141S~144S connected in parallel with the respective diodes 141D~144D. Further, between the anode side high voltage inverter 16*a* and the neutral point of the X-ray tube 18*a* a high voltage capacitor 17*a* is connected and between the cathode side high voltage inverter 16*b* and the neutral point in the X-ray tube 18*a* a high voltage capacitor 17*b* is connected and the both function to smooth the respective output voltages. In the manner illustrated in FIG. 1, the switching means 161S~164S of the anode side high voltage inverter 16*a* and the switching means 165S~168S of the cathode side high voltage inverter 16*b* are respectively controlled by switching control means 1 which perform switching control so as to alternatively turn on and off the respective switching means in the same manner as in the case in embodiment 1. In a similar manner, the switching control means 1 also controls switching of the switching means 13S and 141S~144S.

Figure 4:
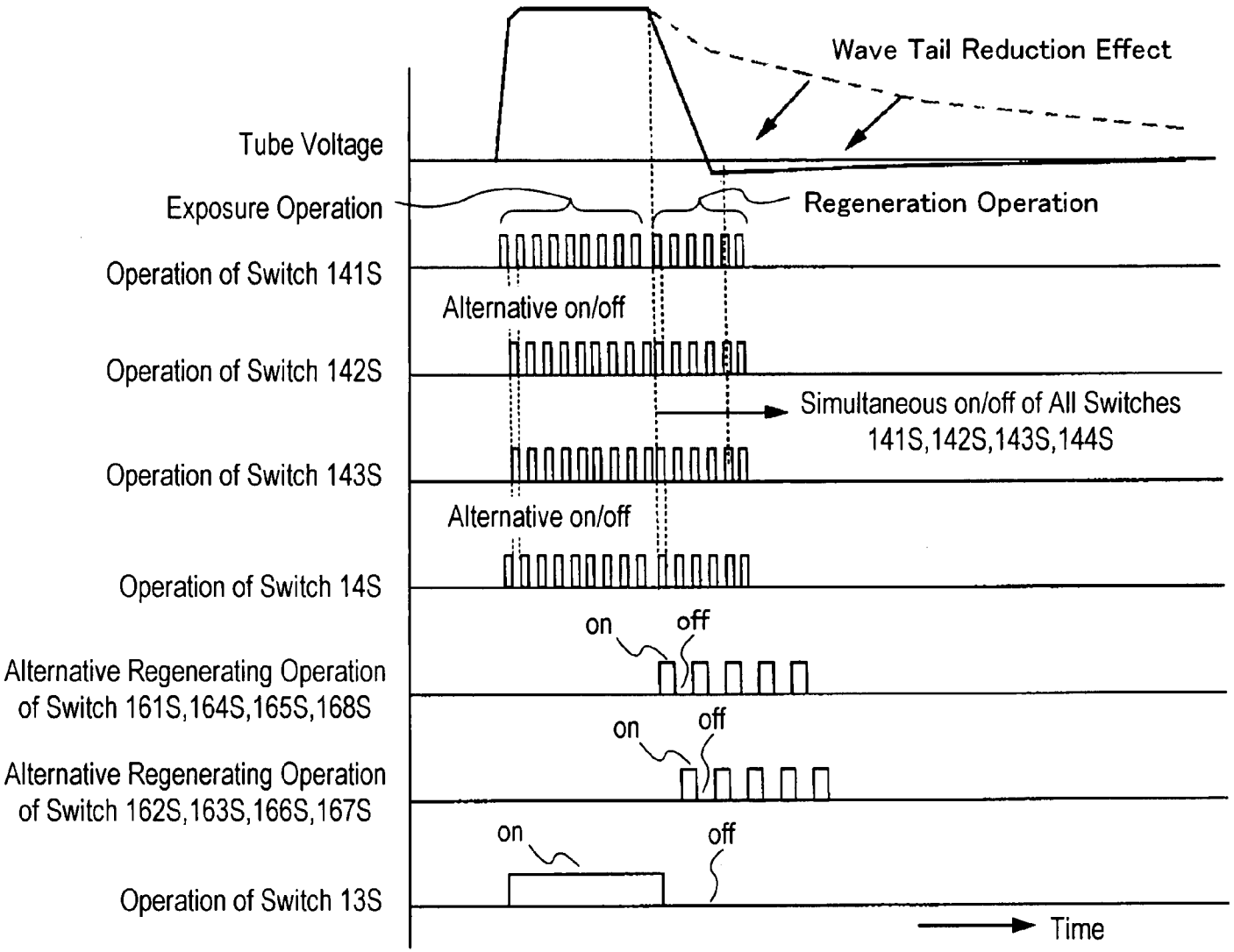
FIG. 4 is an operation waveform diagram of the X-ray high voltage device as shown in FIG. 3.

FIG. 4 is an operation waveform diagram showing an operation of the X-ray high voltage device as shown in FIG. 3.

When the switching means 13S in the semiconductor switch 13 as shown in FIG. 3 is turned on to render the low voltage side inverter 14 operative and to supply a high frequency AC to the high voltage transformer 15, the output voltage is rectified by the high voltage inverter 16, further, the rectified voltage is smoothed by the high voltage capacitors 17*a* and 17*b*, and thus a high speed building up voltage as shown in the drawing is applied to the X-ray tube 18*a*.

On the other hand, when dropping the tube voltage, by turning off the switching means 13S in the semiconductor switch 13 immediately after t2 as shown in FIG. 7, the output from the smoothing capacitor 12 is interrupted. At this moment, all of the switching means 141S~144S in the low voltage inverter 14 are turned on and off at the same time. Further, the switching means 161S and 164S and the switching means 162S and 163S in the anode side high voltage inverter 16*a* of the high voltage inverter 16 are alternatively on and off controlled, and at this moment, when the switching means 165S and 168S in the cathode side high voltage inverter 16*b* are on and off controlled in synchronism with the switching means 161S and 164S in the anode side high voltage inverter 16*a* as well as the switching means 166S and 167S in the cathode side high voltage inverter 16*b* are on and off controlled in synchronism with the switching means 162S and 163S, the electric charges stored respectively in the high voltage capacitors 17*a* and 17*b* cause to supply an AC high voltage to the secondary side of the high voltage transformer 15.

During the period when the switching means 141S~144S in the low voltage side inverter 14 are simultaneously rendered on, since the voltage at the primary side of the high voltage transformer 15 is zero, an electric power is supplied from the secondary side thereof. At this moment, the current flowing to the primary side of the high voltage transformer 15 flows continuously while being limited by the parasitic leakage inductance 15L. Subsequently, when all of the switching means 141S~144S in the low voltage inverter 14 are turned off simultaneously, the diodes 141D~144D and the diode 13D are rendered conductive and the current induced in the parasitic leakage inductance 15L charges the smoothing capacitor 12 and is regenerated. The principle above is the same as that explained in connection with embodiment 1.

The above explained X-ray high voltage device can regenerate energy of electric charges stored in the high voltage capacitors 17*a* and 17*b* into the smoothing capacitor 12. For this reason, the tube voltage is suddenly dropped and the wave tail thereof can be greatly reduced as shown in FIG. 4 without complexing the structure of the high voltage side as well as without being troubled by counter measuring the heating of the current limiting use impedance. In addition, because the present X-ray high voltage device is a type in which the anode side high voltage inverter 16*a* and the cathode side high voltage inverter 16*b* are connected to the neutral point of the X-ray tube 18*a*, the respective withstanding voltages of the switching means 161S~168S can be halved in comparison with those in embodiment 1, therefore, when the switch is constituted by a cascade connected MOSFETs as shown in FIG. 3 of JP-A-2001-284097 and in FIG. 2 of JP-A-8-212948, number of the MOSFETs can be reduced. Thus constituting the switch, since the time when all of the cascade connected MOSFETs complete turning on can be halved, an advantage is obtained that the operating frequency of the high voltage inverter can be increased.

Embodiment 3

Figure 5:
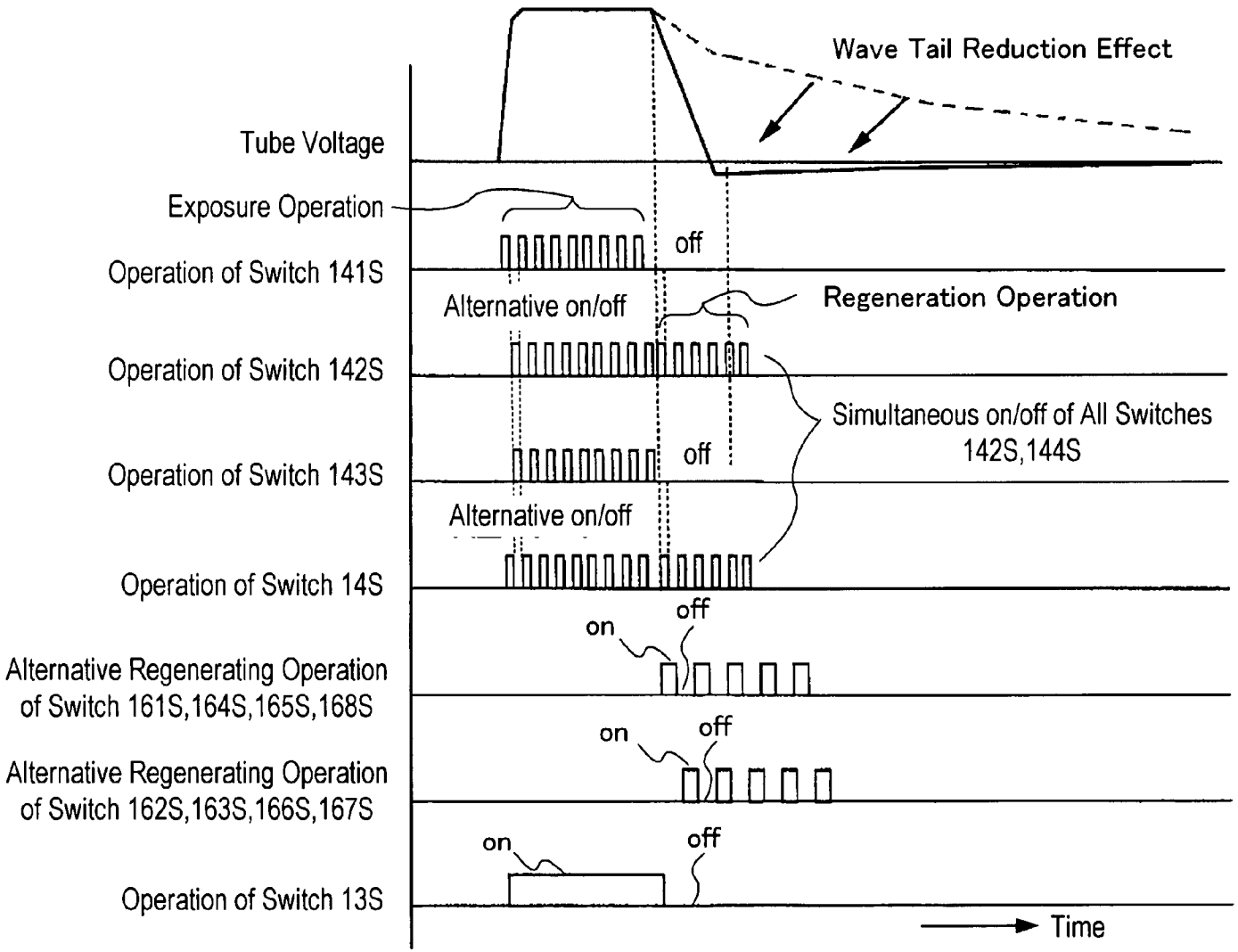
FIG. 5 is an operation waveform diagram of the X-ray high voltage device according to embodiment 3 of the present invention.
Figure 6:
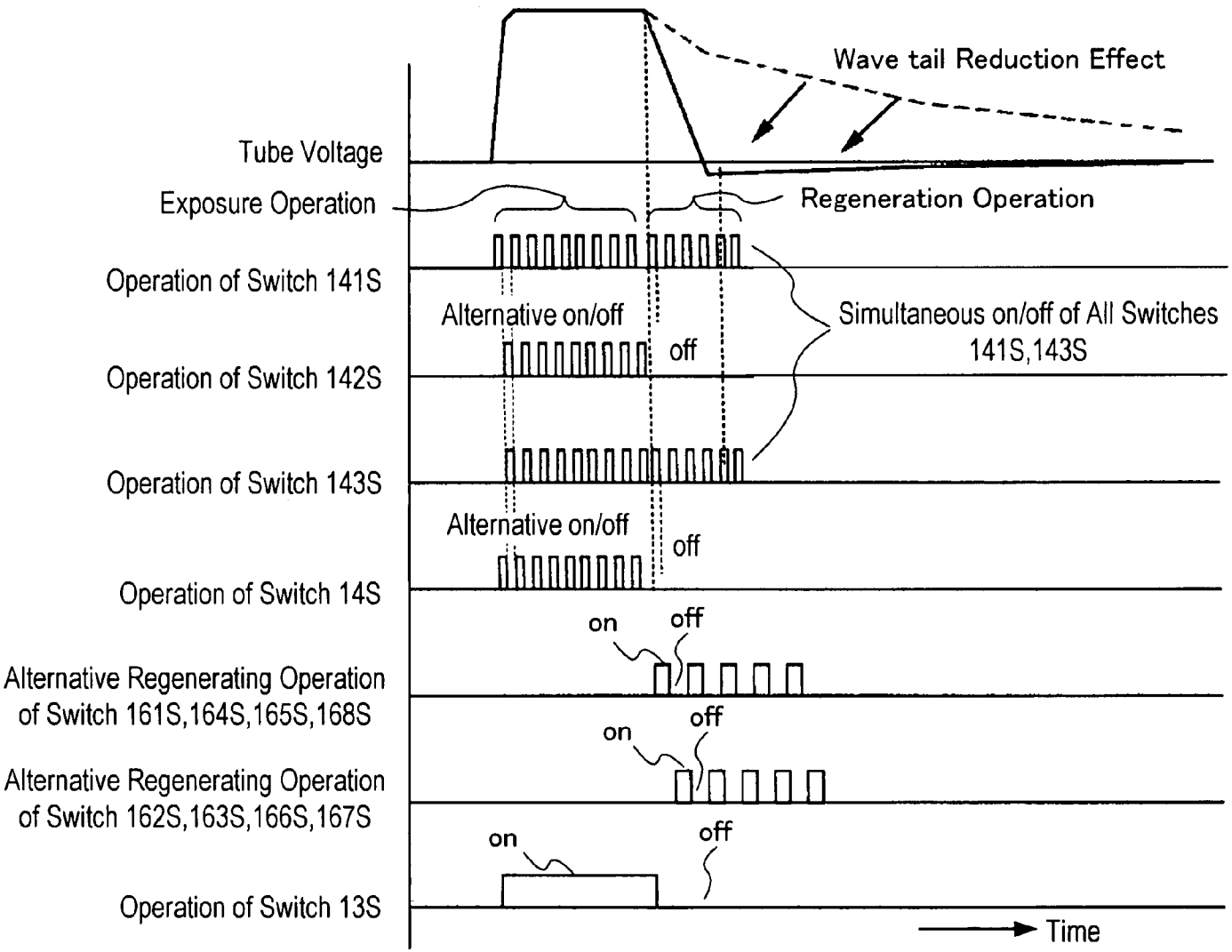
FIG. 6 is another operation waveform diagram of the X-ray high voltage device according to embodiment 3 of the present invention.

FIGS. 5 and 6 are operation waveform diagrams showing an operation of an X-ray high voltage device according to a further embodiment of the present invention.

Although in the X-ray high voltage devices shown in connection with FIGS. 1 and 3 embodiments, when dropping the tube voltage of the X-ray tubes 18 and 18*a* at t2 in FIG. 7, the switching means 141S~144S in the low voltage side inverter 14 are simultaneously turned on and off, however, in the present embodiment, when dropping the tube voltage, the switching means of one group in the bridge connection are always turned off and only the remaining other group are simultaneously on and off controlled. Namely, in FIG. 5 embodiment, the switching means 142S and 144S are simultaneously on and off controlled while keeping the switching means 141S and 143S turned off, and in FIG. 6 embodiment, the switching means 141S and 143S are simultaneously on and off controlled while keeping the switching means 142S and 144S turned off.

Even with the X-ray high voltage device according to the present embodiment, the voltage at the primary side of the high voltage transformer 15 can be rendered to zero, the energy in the secondary side of the high voltage transformer 15 can be transferred to the primary side thereof. Thus the energy can be regenerated into the smoothing capacitor 12, as a result, the tube voltage is suddenly dropped and the wave tail thereof can be greatly reduced.

Further, as the rectifier 11 in the above explained respective embodiments, a bridge circuit using thyristors and an AC/DC rectifier circuit using such as voltage drive type MOSFETs and IGBTs can be used in place of such as the diode bridge and the diodes. Still further, the switching means 161S~168S in the high voltage side inverter 16 can be constituted by switching elements having higher withstanding voltage and faster switching speed such as SiC-MOSes in place of the MOSFETs so as to reduce number of stages in the series connection. Still further, in the embodiments, although the energy of electric charges stored in the high voltage capacitor 17 is regenerated into the smoothing capacitor 12 located at the forestage of the low voltage side inverter 14, other than the smoothing capacitor 12 such as another DC source, a battery and a capacitor of another use may be provided which likely regenerate the energy of electric charges stored in the high voltage capacitor 17 to the primary side representing the low voltage side of the high voltage transformer 15, in this instance, the regenerated energy can be utilized for another use other than the tube voltage generation.

The invention claimed is:

1. A high voltage device comprising a low voltage DC source, a low voltage side inverter of which an input side is connected to the low voltage DC source and inverts the current from the low voltage DC source into high frequency AC voltage and outputs the same at an output side, a high voltage transformer of which a primary winding is connected to the output side of the low voltage side inverter and boosts up the high frequency AC voltage from the low voltage inverter, a high voltage rectifier of which an input side is connected to a secondary winding of the high voltage transformer and which rectifies the AC voltage boosted up by the high voltage transformer and provides an output at an output side, a high voltage side capacitor connected to the output side of the high voltage rectifier and an X-ray generation device connected between terminals of the high voltage side capacitor, characterized in that the high voltage device is further provided with a regenerating means for regenerating electric charge energy stored in the high voltage side capacitor from the high voltage side capacitor to the low voltage DC source via the high voltage transformer and with a regeneration control means connected with the regenerating means and for controlling an operation of the regenerating means.

2. A high voltage device according to claim 1, characterized in that the regenerating means enables reduction of voltage at an input side to be lower than an voltage at the output side.

3. A high voltage device according to claim 1, characterized in that the regenerating means is provided between an output side of the low voltage DC source and an input side of the high voltage side capacitor.

4. A high voltage device according to claim 1, characterized in that the regenerating means is at least a current control means provided between the low voltage DC source and the high voltage transformer.

5. A high voltage device according to claim 4, characterized in that the regenerating means is an element which only allows current conduction from an output side to an input side during a regeneration period and allows bi-directional current conduction at other than the regeneration period.

6. A high voltage device according to claim 5, characterized in that the element is a parallel connection of a diode and a switch.

7. A high voltage device according to claim 6, characterized in that the regeneration control means turns off the switch in the current control means provided between the low voltage DC source and the high voltage transformer at the start of the regeneration period.

8. A high voltage device according to claim 1, characterized in that the regenerating means is at least provided in the high voltage rectifier.

9. A high voltage device according to claim 8, characterized in that the high voltage rectifier is further provided with at least one switching element which receives the electric charges in the high voltage side capacitor, inverts the same into an AC and returns the same to the input side.

10. A high voltage device according to claim 8, characterized in that the high voltage rectifier is constituted by a diode bridge and switching elements each of which is connected in parallel with respective diodes constituting the diode bridge.

11. A high voltage device according to any one of claims 9 and 10, characterized in that the regeneration control means controls at least one switching element in the high voltage rectifier to invert the electric charge energy into AC and to return the energy to the input side during the regeneration period.

12. A high voltage device according to claim 11, characterized in that a switching frequency of the low voltage side inverter is higher than an AC frequency of the switching element in the high voltage rectifier.

13. A high voltage device according to claim 1, characterized in that the regenerating means is the low voltage side inverter.

14. A high voltage device according to claim 1, characterized in that the regeneration control means enables reduction of voltage at an input side to be lower than voltage at an output side by switching of the low voltage side inverter.

15. A high voltage device according to claim 1, characterized in that the X-ray generation device is a neutral point grounded type X-ray generation device and the high voltage rectifier is provided at least in two sets.

16. A high voltage device according to claim 1, characterized in that the low voltage DC source includes at least one of a capacitor and a battery.

17. An X-ray high voltage device comprising:

a DC power supply means with a low voltage electric charge storing means, a DC/AC inverting means which inverts an output of the DC power supply means into a high frequency AC voltage and outputs the same, a high voltage transforming means which boosts up the high frequency AC voltage from the DC/AC inverting means, a rectifying means which rectifies the boosted up high frequency AC voltage and generates a DC high voltage, a high voltage electric charge storing means including stray capacitance of cables connected to an output side of the rectifying means, and an X-ray generating means which is connected between terminals of the high voltage electric charge storing means and receives DC high voltage from the high voltage electric charge storing means, when an X-ray irradiation command is turned on, and generates X-ray, characterized in that, the rectifying means is provided with a first regenerating means which causes electric charges in the high voltage electric charge storing means to flow to the high voltage transforming means and the X-ray high voltage device is further provided with a second regenerating means which causes to the electric charges flowed to the high voltage transformer means to flow to the DC power supply means, when the X-ray irradiation command is turned off.

18. An X-ray high voltage device according to claim 17, characterized in that the first regenerating means is a DC/AC inverting means which is incorporated in the rectifying means and the second regenerating means includes a semiconductor element which is connected between the DC power supply means and the DC/AC inverter and allows current conduction only in a direction from the DC/AC inverting means to the DC power supply means, when the X-ray irradiation command is turned off.

* * * * *